US005952913A

United States Patent [19]

Cioletti et al.

[11] Patent Number: 5,952,913

[45] Date of Patent: Sep. 14, 1999

[54] SUSTAINING TIMER FOR A SAFETY LIGHT

[76] Inventors: Joseph T. Cioletti; Kathryn J. Cioletti, both of 684 Blue Ridge Dr., Pittsburgh, Pa. 15239

[21] Appl. No.: 08/943,035

[22] Filed: Oct. 2, 1997

[51] Int. Cl.[6] ..... G08B 1/00

[52] U.S. Cl. ..... 340/309.15; 340/321; 340/331; 340/432; 340/429; 362/473

[58] Field of Search ..... 340/309.15, 321, 340/331, 332, 432, 689, 429; 315/200 A; 362/473

[56] References Cited

U.S. PATENT DOCUMENTS

| | | | |
|---|---|---|---|
| 3,735,298 | 5/1973 | Colby | 335/207 |
| 3,827,024 | 7/1974 | Anderson et al. | 340/463 |
| 4,019,171 | 4/1977 | Martelet | 340/432 |
| 4,468,656 | 8/1984 | Clifford et al. | 340/321 |
| 4,847,589 | 7/1989 | Dobbins | 340/326 |
| 5,175,528 | 12/1992 | Choi et al. | 340/331 |
| 5,633,623 | 5/1997 | Campman | 340/321 |
| 5,667,290 | 9/1997 | Cioletti | 340/432 |

FOREIGN PATENT DOCUMENTS

| | | |
|---|---|---|
| 135850 | 6/1991 | Japan . |

*Primary Examiner*—Donnie L. Crosland

[57] ABSTRACT

An array of randomly flashing warning lights comprised of high intensity Light Emitting Diodes, alert observers to the presence of moving vehicles or pedestrians. Motion sensors such as tilt, reed, or mercury switches can be used to achieve randomized flashing while vehicle or pedestrian are in motion. Dynamic forces, generated by motion, cause sensor contact closures which, in turn, produce short duration pulses of light to be emitted by the LED array. When motion ceases, an auxiliary circuit automatically causes the LED array to continue flashing for a period of about one-minute. The extended period of flashing will continue to alert observers should the vehicle or pedestrian stop for a traffic light, stop sign, or sundry other reasons. Termination of the warning light's activity will result in a power-down state wherein power consumption becomes so minute it eliminates the need for an on-off switch.

2 Claims, 3 Drawing Sheets

SUSTAINING TIMER FOR A SAFETY LIGHT

FIELD OF THE INVENTION

The present invention relates to safety lights.

BACKGROUND OF THE INVENTION

The need to protect bicyclists, joggers, and walkers during dusk and nighttime activity is of primary concern given the number of fatalities and injuries logged amongst them during that period. Devices such as reflectors or reflective tapes have achieved a plateau in their development; no significant improvements have been achieved during the past several years as reported by the Consumer Products Safety Commission. Consequently, the CPSC is leaning toward the use of lights as warning devices, particularly singling out the use of Light Emitting Diodes. However, specific standards for their implementation have not yet been established.

Flashing lights are known to attract more attention than steadily glowing lights and the color red is basically standardized as a hazard identifier. Red is a particularly good light source since, for inclement conditions, red light has greater penetrating capability than other colors. High intensity Red Light Emitting Diodes are readily available, energy efficient, economical, long lived, and have rapid response times making them ideal choices for safety lights.

A previously disclosed invention, U.S. Pat. No. 5,667,290 called a MAGNETO-INDUCTIVELY ACTUATED SAFETY LIGHT, provides the foundation for the invention disclosed herein. Briefly, the previously disclosed device teaches that light pulses are triggered by a magnetically actuated switch. Although flash intensity is independent of rotational speed, flashing frequency depends upon the rotational speed of the bicycle's wheel and the number of magnets used to actuate one or more Reed Switches. Of primary importance is the fact that current drawn from the battery when the bicycle is idle is insignificant. Consequently, no on-off switch is needed thereby making the SAFETY LIGHT active at all times, day or night. However, there was no provision for extending the warning flash period when the bicycle came to a stop.

SUMMARY OF THE INVENTION

The SUSTAINING TIMER described herein extends the capability of the MAGNETO-INDUCTIVELY ACTUATED SAFETY LIGHT by providing a flashing light warning for a period of approximately one minute after bicycle motion has ceased. An initial delay of 2 to 3 seconds prior to initiation of flashing insures that brief stops or slow movement of the bicycle will not result in unnecessary signals. The SUSTAINING TIMER derives its triggering signal from the MAGNETO-INDUCTIVELY ACTUATED SAFETY LIGHT circuit. The SUSTAINING TIMER described herein is automatically terminated when motion is resumed. The circuitry that accomplishes this task draws less than 10 millionths of an ampere of quiescent current thus preserving without compromise the criteria and claims of the MAGNETO-INDUCTIVELY ACTUATED SAFETY SWITCH.

Figure 1:
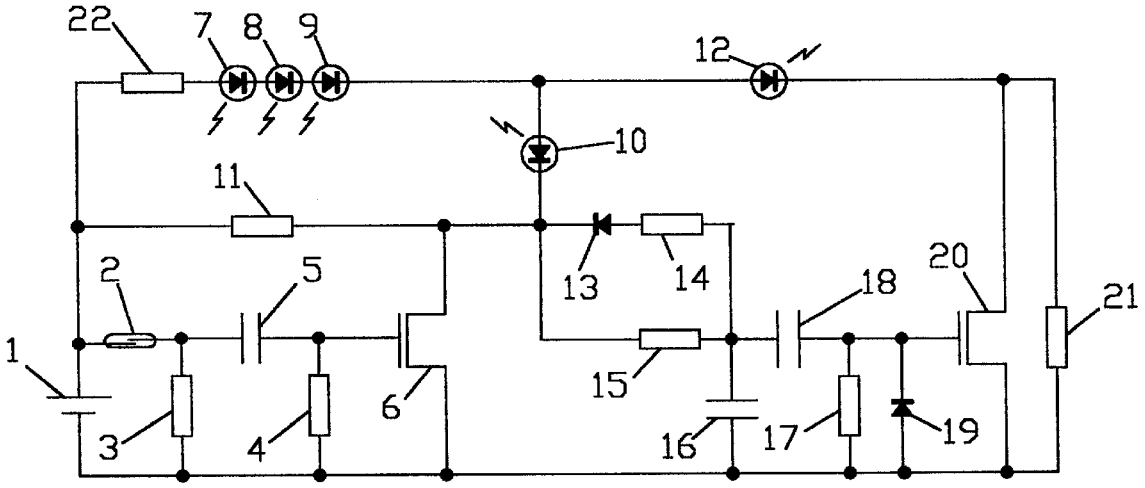
FIG. 1 displays the schematic diagram for the combined MAGNETO-INDUCTIVELY ACTUATED SAFETY LIGHT and the SUSTAINING TIMER.

A Reed Switch (2) attached to the bicycle and actuated by bicycle movement is electrically connected to a Printed Circuit Board (24) comprising the circuit depicted in FIG. 1. Connecting Wires (2*a* and 2*b*) are routed through penetrations in the Battery Holder (27) and Cover (25) and are connected to the Printed Circuit Board (24). Connecting Wires (2*a* and 2*b*) provide contact closure pulses to the Printed Circuit Board (24). The Printed Circuit Board (24) is adhesively joined to a translucent, clear or red Lens (23). A Cover (25), through which power and signal connections have been routed and attached to the Printed Circuit Board (24), is adhesively attached to the back end of the Lens (23) forming a chamber bounded by the Printed Circuit Board (24), the Cover (25) and the Lens (23). This chamber is filled with a potting compound to completely protect the Printed Circuit Board (24) from moisture. The assembly comprised of the Lens (23), Printed Circuit Board (24) and Cover (25), is adhesively connected to a Battery Holder (27) having an integral lug with a through-hole suitable for adapting to sundry mounting hardware. Further depicted is a 9 Volt Battery (29) and a standard Snap-on Connector (28) whose wires are routed through Cover (25) and connected to the Printed Circuit Board (24). The Battery (29) is held in place by the Battery Holder Cover (26) and Screw Fasteners (30).

Figure 2:
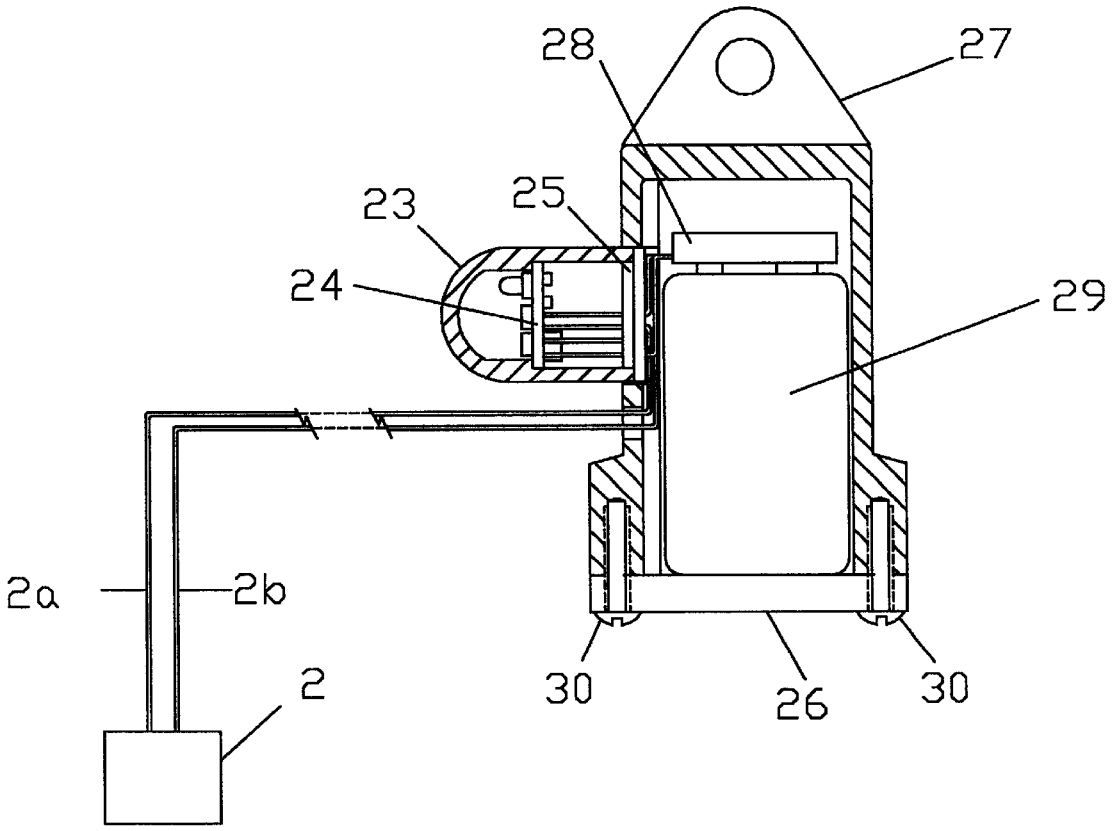
FIG. 2 displays an assembly suitable for mounting on a bicycle being comprised of the following.
Figure 3:
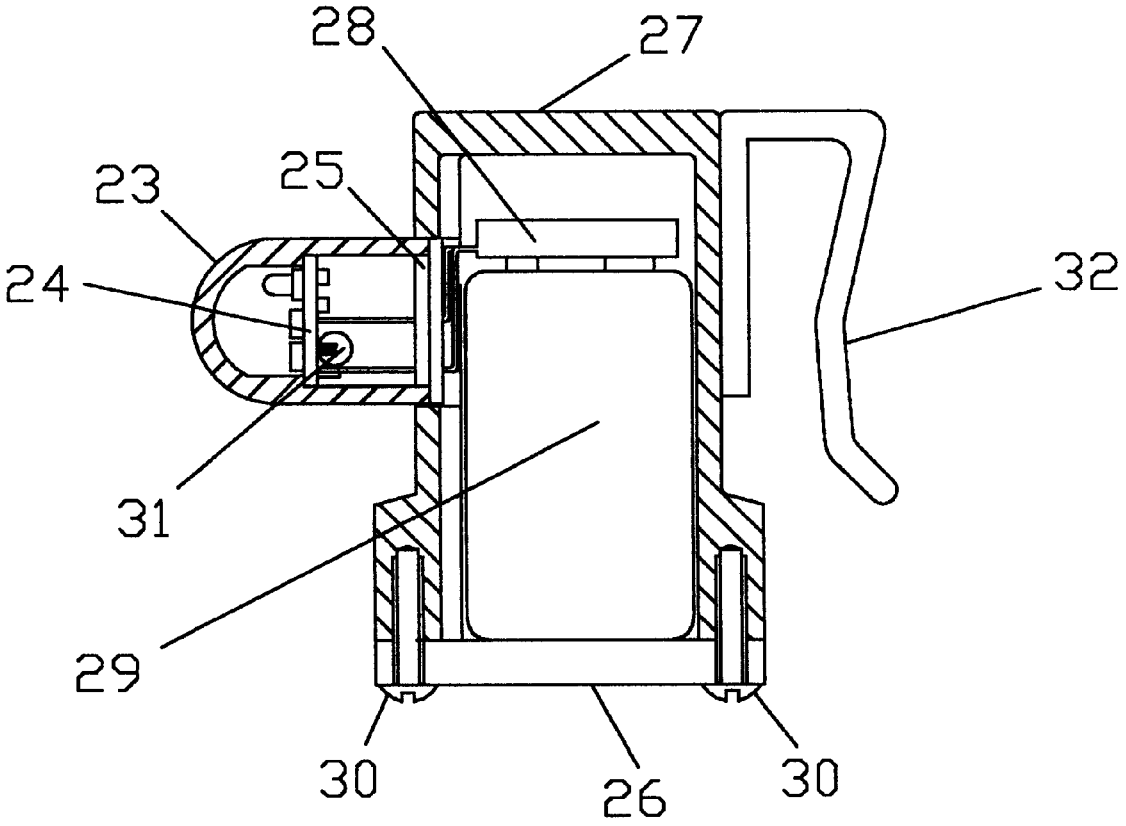

FIG. 3 shows a fully portable assembly. In this embodiment, the Reed Switch (2) and Connecting Wires (2*a* and 2*b*) depicted in FIG. 2 are replaced with a Mercury Switch (31) which is attached directly to the Printed Circuit Board (24). The Battery Holder (27) has been modified to eliminate the lug with the through-hole. A Clip (32) replaces the lug thus permitting the attachment of the assembly to a belt, waistband or other convenient location. The Mercury Switch (31) requires insignificant dynamic forces to actuate the circuit such as those generated by jogging or walking. The Mercury Switch (31) replaces and serves the same purpose as the Reed Switch (2) described above for FIG. 2 or for the MAGNETO-INDUCTIVELY ACTUATED SAFETY SWITCH

DESCRIPTION OF THE PREFERRED EMBODIMENT

Items 1 through 10 of FIG. 1 depict the components and operation of the device described in U.S. Pat. No. 5,667,290. The remainder of the circuitry, including Resistor (22), represents the SUSTAINING TIMER described below.

Referring to FIG. 1, during the operation of the MAGNETO-INDUCTIVELY ACTUATED SAFETY SWITCH, the voltage generated at the junction of LED (10) and MOS-FET (6) reflects the action of the Reed Switch (2). Closure of the Reed Switch (2) causes the MOS-FET (6) to conduct momentarily, turning on LEDs (7, 8, 9, and 10). When the Reed Switch (2) remains inactive, MOS-FET (6) shuts off and the voltage at the junction of LED (10) and the MOS-FET (6) will rise until it is equal to the Battery (1) voltage. If no current is being drawn from the junction, the voltage rise at the junction would be instantaneous. The preceding action identifies a new use of the MAGNETO-INDUCTIVELY ACTUATED SAFETY SWITCH as a motion detector. The preferred embodiment of the SUSTAINING TIMER includes the circuitry for the MAGNETO-INDUCTIVELY ACTUATED SAFETY SWITCH.

In order to accommodate slow bicycle speed or short stops, the SUSTAINING TIMER provides a 2 to 3 second delay prior to going into a flashing LED mode wherein high intensity LEDs flash at full brilliance for a period of approximately one minute. Subsequently, light intensity diminishes to the point where the SUSTAINING TIMER'S contribution to battery current drain becomes less than 10 millionths of an ampere. When bicycle motion is detected by even a single pulse from the Reed Switch (2), the SUSTAINING TIMER is reset and system operation automatically reverts to the MAGNETO-INDUCTIVELY ACTUATED SAFETY SWITCH mode of operation.

DESCRIPTION OF OPERATION

Two response modes are associated with the SUSTAINING TIMER. The first mode occurs when the bicycle is stopped for more than one minute. The second mode is active whenever the bicycle is in motion.

Mode 1: Response While Stopped or Parked

When MOS-FET (6) is turned off, electric current flows from the positive side of the Battery (1) through Resistors (11 and 15) and charges Capacitors (16 and 18). The increasing voltage generated at the junction of Capacitor (16) and Capacitor (18) by the charging current is imposed on the gate of MOS-FET (20). It was discovered that this voltage had to rise to approximately 4 volts before the MOS-FET (20) would become fully conductive, allowing LEDs (7, 8, 9, and 12) to achieve full brilliance. Flashing of the LEDs is accomplished by interposing a blinking LED (12) in series with LEDs (7, 8 and 9). LED (12) is a commercially available component containing internal circuitry to provide the flashing mode of operation. The SUSTAINING TIMER uses LED (12) as both a switch and an indicator. The signal voltage necessary for full conduction of MOS-FET (20) allows for controlling the length of time for on-delay by values selected for Resistors (11 and/or 15) and Capacitors (16 and/or 18). As Capacitor (18) becomes fully charged, the gate on MOS-FET (20) attains the same voltage as the source through Resistor (17) causing MOS-FET (20) to shut off. Consequently, the LEDs no longer flash and the current drawn by the SUSTAINING TIMER drops to less than 10 millionths of an ampere. It was further discovered that LED (12) required a trickle current flow of approximately 4 millionths ampere for reliable operation which was achieved by bridging MOS-FET (20) with Resistor (21). Without this trickle current, the internal circuitry for LED (12) achieves a state of saturation and disables the SUSTAINING TIMER. Positioning of LED (10) as depicted in FIG. 1 prevents the discharge of Capacitors (16 and 18) through MOS-FET (20) during its conducting phase. Resistor (11) is necessary to bypass LEDs (7, 8, 9, and 10), which, having high resistance when they are not conducting, would compromise the ability to charge Capacitors (16 and 18). Resistor (22) is included to limit current through the LEDs and also to permit the use of higher voltages for the Battery (1) source.

Mode 2: Response While Bicycle is in Motion

When MOS-FET (6) is not conducting, Capacitors (16 and 18) will continue to charge until they reach Battery (1) voltage as a limit. However, the instant that MOS-FET (6) is conducting, Capacitors (16 and 18) are presented an almost short circuit path consisting of Resistor (14) and Diodes (13 and 19). Diodes (13 and 19) are selected based on characteristic low forward drop, typically 0.5 volts or less, and Resistor (14) is selected to limit the discharge current. The components used for the prototype circuit allowed for almost complete discharge of the capacitors with only one pulsed closure of the Reed Switch (2). Subsequent pulses produced within the delay period described above maintained the SUSTAINING TIMER in a standby mode.

Second Embodiment

Referring to FIG. 3, a second embodiment of the herein described SUSTAINING TIMER employs the use of a Mercury Switch (31). The Mercury Switch (31) is directly mounted to a Printed Circuit Board (24) using the same connection points assigned to the Reed Switch (2) for the preferred embodiment described above. This feature allows the assembly depicted in FIG. 3 to become completely portable for use by joggers or walkers. A small drop of mercury bridges across contacts in the switch thus providing a signal pulse to the above described circuitry. Walking or jogging would produce random actuations. The level of quiescent power drain contributed by the SUSTAINING TIMER also precludes the need for an on-off switch thus not compromising the original claims for the MAGNETO-INDUCTIVELY ACTUATED SAFETY SWITCH.

Special Construction

A very small Printed Circuit Board (24) is necessary from the standpoint of esthetics and cost effectiveness. The majority of bicycle riders demand products that are light weight and small in size; features will also provide for savings in materials and manufacture. Consequently, the Printed Circuit Board (24) has a footprint of 1.06×0.56 inches which was accomplished using Surface Mount Technology (SMT) with components mounted on both sides of the Printed Circuit Board (24).

We claim:

1. An operator-independent safety device requiring no on-off switch that is always active and used for detecting and annunciating motion using either magnetically actuated or tilt actuated switches, said switches receiving random signals produced by said motion and providing minuscule pulsed signals to a battery driven power control circuit capable of rapidly switching Light Emitting Diodes or LEDs and comprising:

a.) one or more moving magnet members attached to a support movable in motion, b.) one or more said magnetically actuated switches in communication with said magnet members, c.) alternate to said moving magnet members and said magnetically actuated switches one or more said tilt actuated switches attached to said safety device and receiving actuation directly through said motion of said safety device, d.) whereby said switches provides miniscule pulse signals to said power control circuit, e.) said minuscule pulsed signals conducting currents that are considerably lower than current carrying capacity of said switches insuring extremely long switch life, f.) whereby said power control circuit limits length of time said LEDs are lit, g.) thereby eliminating the need for disabling said power control circuit thereby extending battery life and ensuring said power control circuit is active at all times, h.) said power control circuit including a solid state device with high power and rapid response capabilities suitable for driving said LEDs.

2. A device as defined in claim 1, wherein said safety device provides additional annunciation during a fixed period of time after cessation of said motion by flashing LEDs for a fixed period of time and comprising:

a) cessation of motion initiates a short time delay in said power control circuit to preclude unnecessary flashing of said LEDs, b) whereby said power control circuit produces flashing of said LEDs for a fixed period upon completion of a short time delay, c) whereby said power control circuit ceases flashing of said LEDs upon completion of a fixed period, d) whereby said power control circuit limits said battery current drain to an insignificant level upon completion of a fixed period.

* * * * *